United States Patent [19]

Chen et al.

[11] 4,016,648

[45] Apr. 12, 1977

[54] SAFETY RAZOR

[75] Inventors: Evan Nai-keung Chen; Edward A. Beddall, both of Fairfield, Conn.

[73] Assignee: Warner-Lambert Company, Morris Plains, N.J.

[22] Filed: Aug. 13, 1975

[21] Appl. No.: 604,505

[52] U.S. Cl. ..... 30/47; 30/304

[51] Int. Cl.[2] ..... B26B 21/06

[58] Field of Search ..... 30/47, 50, 346.58, 346.59, 30/304, 305

[56] References Cited

UNITED STATES PATENTS

| | | | |
|---|---|---|---|
| 1,975,757 | 10/1934 | Gray | 30/50 |
| 2,044,698 | 6/1936 | John | 30/50 |
| 3,262,206 | 7/1966 | Tomek | 30/50 X |
| 3,890,704 | 6/1975 | Ferraro | 30/50 X |

FOREIGN PATENTS OR APPLICATIONS

| | | | |
|---|---|---|---|
| 975,332 | 10/1950 | France | 30/50 |
| 447,678 | 5/1936 | United Kingdom | 30/304 |

*Primary Examiner*—Gary L. Smith

*Attorney, Agent, or Firm*—Albert H. Graddis; Jeremiah J. Duggan

[57] ABSTRACT

A safety razor comprises a blade seat member having a transversely elongated guard surface, and a first plurality of upwardly extending support posts. A first razor blade is situated on the blade seat member with a cutting edge spaced upwardly and rearwardly of the guard surface. A plurality of perforations are formed in the first blade and the first plurality of support posts extend upwardly through the perforations. A second razor blade is positioned above the first blade in abutting engagement with the top surfaces of the first plurality of support posts. The second blade includes a cutting edge spaced upwardly and rearwardly of the cutting edge of the first blade, and a plurality of perforations formed therethrough. A cap member is positioned above the second blade, and includes a second plurality of support posts extending downwardly through the perforations in the second blade and in abutting engagement with the top surface of the first blade. The cap and blade seat members are interconnected for permanently bonding the first and second blades between the cap and blade seat members.

6 Claims, 13 Drawing Figures

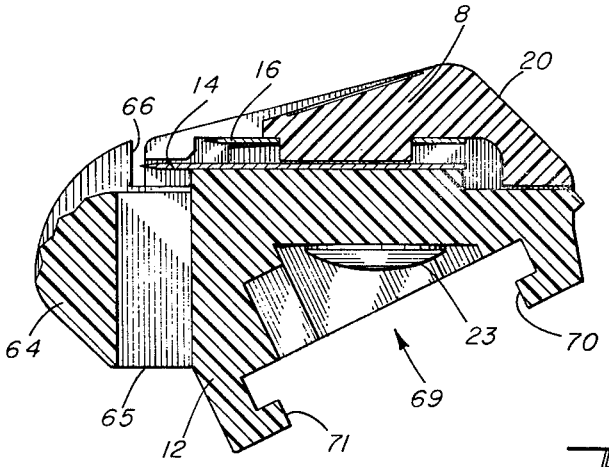
Fig. 11
Fig. 12
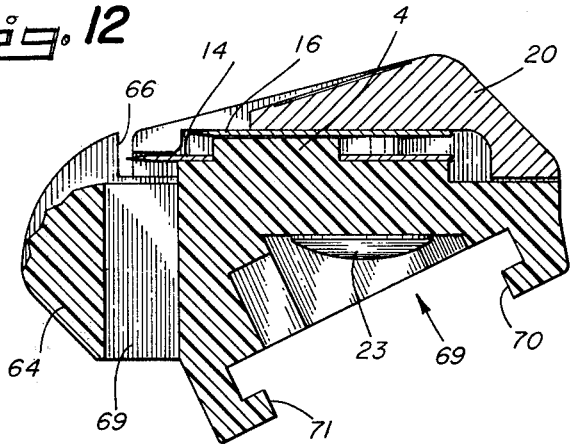
Fig. 13
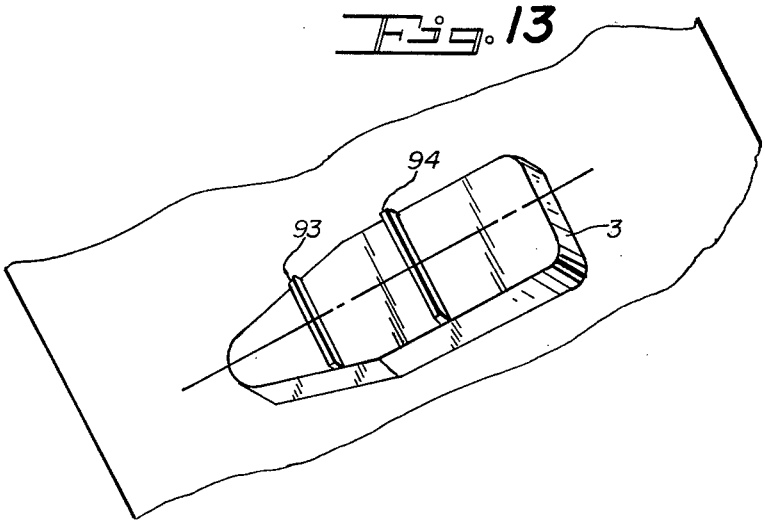

SAFETY RAZOR

BACKGROUND OF THE INVENTION

The present invention relates to safety razors of the type having a plurality of razor blades. More particularly, the present invention relates to a disposable razor or a disposable cartridge having a plurality of razor blades permanently bonded therein.

It is known to position a spacer member between a pair of blades in disposable razor or a disposable razor blade cartridge. U.S. Pat. No. 3,724,070 discloses such a razor blade cartridge having a spacer, and perforations in the bottom blade for washing shaving debris from between the blades. Still, shaving debris tends to collect between the two blades along the forward surface of the spacer.

SUMMARY OF THE INVENTION

In accordance with the present invention, there is provided a disposable safety razor or a disposable safety razor caritridge comprising a blade seat member having a transversely elongated guard surface, and a first plurality of upwardly extending support posts. A first razor blade is located on the blade seat member and includes a cutting edge spaced upwardly and rearwardly of the guard surface. A plurality of perforations is formed in the first blade, and the first plurality of support posts extends upwardly through the perforations in the first blade. A second razor blade is located in abutting engagement with the top surfaces of the first plurality of support posts. The second blade includes a cutting edge spaced upwardly and rearwardly of the cutting edges of the first blade, and a plurality of perforations formed therethrough. A cap member is situated on the second blade and includes a second plurality of support posts extending downwardly through the perforations in the second blade and in abutting engagement with the top surfaces of the first blade. Means interconnect the cap and blade seat members for permanently bonding the first and second blades between the cap and blade seat members.

The plurality of support posts acts to bias each of the blades against the blade seat member and the cap member respectively, to avoid the need for a spacer. By eliminating the spacer between the blades, the present invention provides a space between the blades to permit passage of the shaving debris from between the cutting edges. In a specific embodiment of the present invention, a plurality of posts is formed along the rear of the disposable razor or razor blade cartridge to permit cleansing of shaving debris.

BRIEF DESCRIPTION OF THE DRAWINGS

FIG. 11 is a cross-sectional view of the cartridge taken along lines 11—11 of FIG. 1; and FIG. 12 is a cross-sectional view taken along lines 12—12 of FIG. 1.

FIG. 13 is a perspective view of a support post for separating the blades of the shaving unit.

DESCRIPTION OF SPECIFIC EMBODIMENTS

Figure 1:
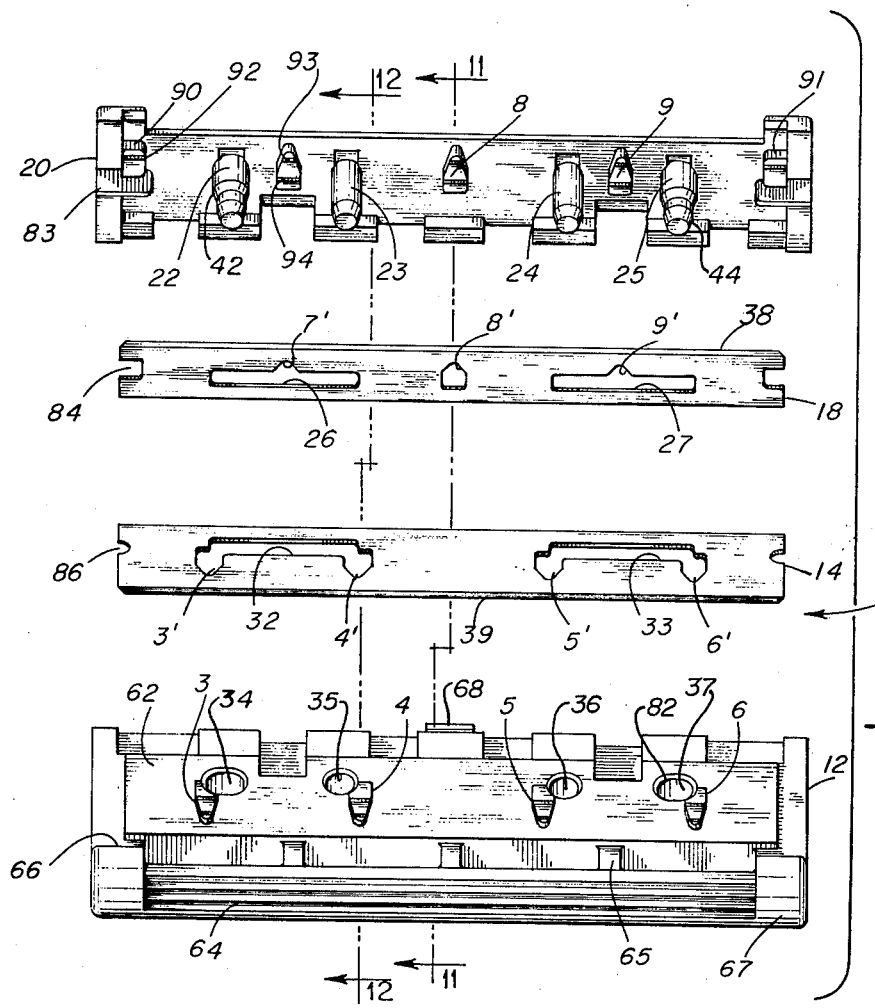
FIG. 1 is an exploded view of a specific embodiment of the present invention showing a disposable razor blade cartridge with the components opened in a fan-like manner.
Figure 2:
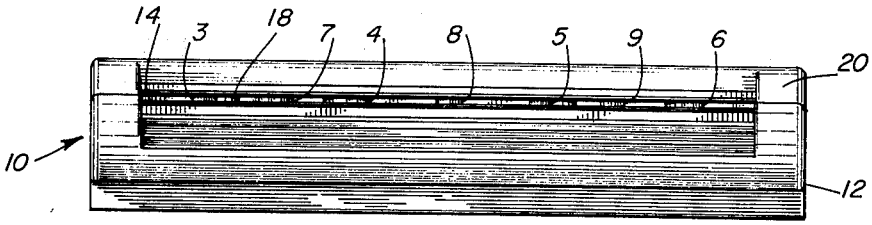
FIG. 2 is a front elevational view of the cartridge of FIG. 1.
Figure 3:
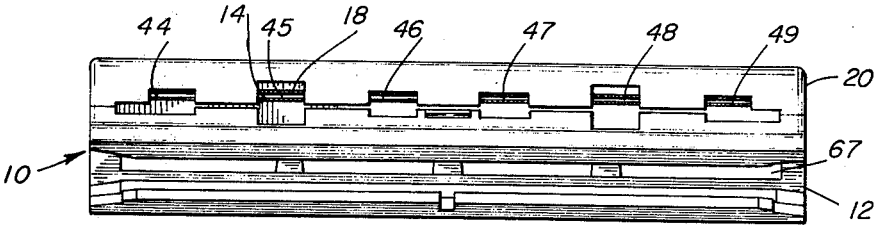
FIG. 3 is a rear elevational view of the cartridge

With reference to FIG. 1, razor blade cartridge 10 comprises a pair of tandemly mounted blades 14, 18 bonded permanently between a cap member 20 and a blade seat member 12. Blades 14, 18 each have a single cutting edge 38, 39 and are maintained in vertically separated state by a first plurality of lands or support posts 3 through 6, and a second plurality of lands or support posts 7 through 9. As shown in FIGS. 11 and 12, the cartridge 10 has a T-shaped channel 69 formed by inwardly directed flange members 70, 71 for releasably securing the cartridge 10 on a holder (not shown).

Figure 4:
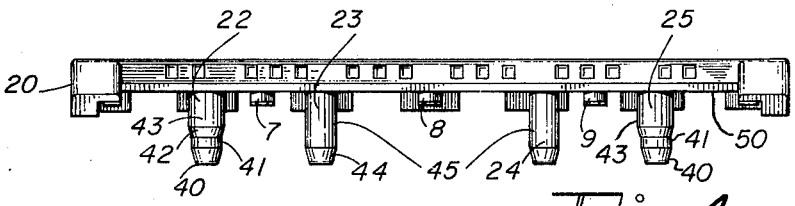
FIG. 4 is a front elevational view of a cap member of the cartridge.
Figure 5:
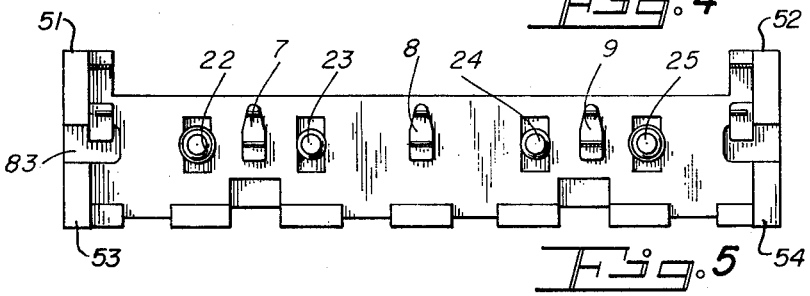
FIG. 5 is a bottom plan view of the cap member shown in FIG. 4.

With reference to FIGS. 4 and 5, cap member 20 has four posts 22 through 25 extending downwardly from recess 50 in the underside of the cap member 20. The cap member 20 also has opposing downwardly extending sidewalls 53, 54, and a pair of spaced downwardly extending front walls 51, 52. Outer posts 22, 25 have beveled lower portion 40, intermediate cylindrical portion and upper cylindrical portions 41, 43. Inner posts 23, 24 have cylindrical portions 45 and beveled lower ends 44.

Figure 6:
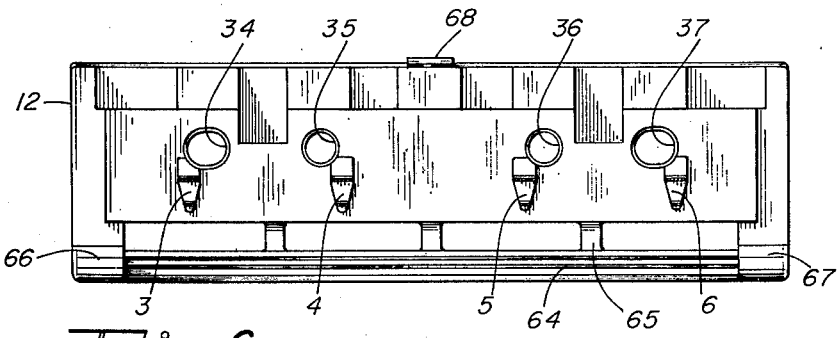
FIG. 6 is a top plan view of a blade seat member of the cartridge.
Figure 7:
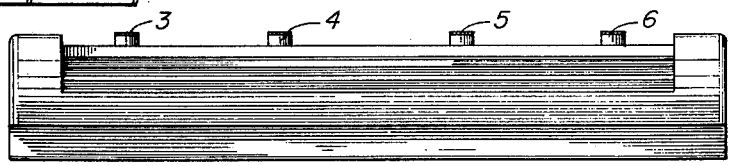
FIG. 7 is a front elevational view of the blade seat member of FIG. 6.
Figure 8:
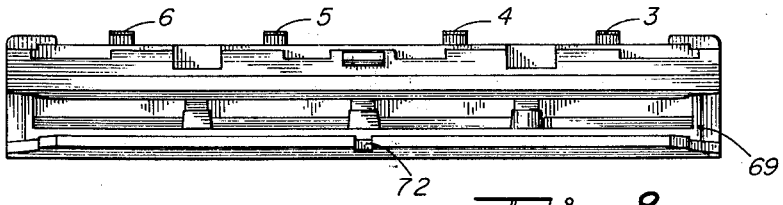
FIG. 8 is a rear elevational view of the blade seat member of FIGS. 6 and 7.
Figure 9:
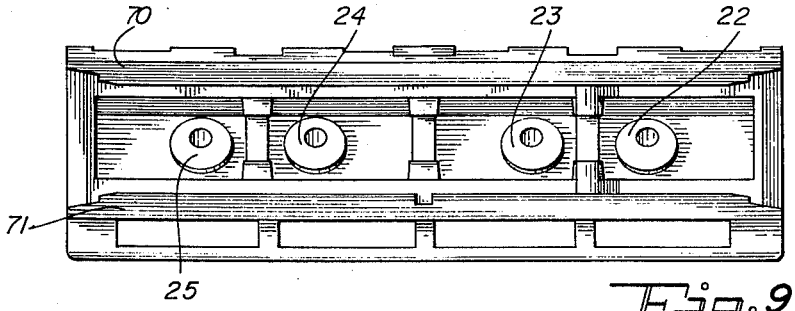
FIG. 9 is a bottom plan view of the blade seat member of FIGS. 6–8.

As shown in FIG. 1, blades 14, 18 have a pair of spaced and transversely elongated slots or apertures 26, 27, 32 and 33. Top blade 18 has a shorter longitudinal dimension than bottom blade 14. FIG. 6 shows blade seat member 12 having a pair of transversely elongated outer holes 34, 37 and a pair of circular inner holes 35, 36. Each of the holes 34 through 37 has a beveled upper portion 82 for guiding the lower beveled portions 44 of the posts 22 through 25 therein. Blade seat member 12 has plateau 62 for seating bottom blade 14. A transversely elongated guard bar 64 is supported forwardly of blade seat member 12 by spaced support element 65. Surfaces 66, 67 extend upwardly from outer ends of guard bar 64 to cover the outer corners of bottom blade cutting edge 39. Boss 68 extends rearwardly from blade seat member 12 to maintain cartridge 10 in a dispenser (not shown). T-shaped channel 69 has a notch 72 formed in flange member 71 for receiving a holder spring (not shown). U.S. Pat. No. 3,784,510 discloses a holder and a dispenser suitable for use with the specific embodiment described herein.

Cartridge 10 may be assembled by inverting cap member 20, and sequentially placing top blade 18, bottom blade 14 and blade seat member 12 on cap member 20 with posts 22, 23 passing through slots 26, 32 and holes 34, 35, with posts 24, 25 passing through slots 27, 33 and holes 36, 37. Lower ends of posts 22 through 25 are staked or otherwise deformed, as shown in FIGS. 11 and 12, to permanently bond the components together. Cap member 20 and the blades 14, 18 have cutout portions 83, 84 and 86 for receiving alignment members (not shown) during assembly. After the components of cartridge 10 are staked, the alignment members are removed.

Intermediate cylindrical portions 41 of outer posts 22, 25 are dimensioned to have a close longitudinal fit in blade apertures 26, 27, 32 and 33 and blade seat outer perforations 34, 37. Intermediate cylindrical portion 41 may have a longitudinal dimension equal to the longitudinal dimension of the bottom blade apertures 32, 33 to provide interference fit. Intermediate beveled portions 42 of outer posts 22, 25 serve to gradually increase longitudinal dimensions of posts 22, 25 such that upper cylindrical portions 43 have a longitudinal interference fit in blade apertures 26, 27, 32 and 33 and blade seat perforations 34, 37. Inner posts 23, 24 have a close fit through blade apertures 26, 27, 32, 33, and inner blade seat holes 35, 36. The transverse dimensions of blade apertures 26, 27, 32, 33, and outer blade seat holes 35, 37 are greater than the diameters of outer posts 22, 25 to provide movement of the outer posts 22, 25 in a transverse direction as interference fitting occurs in a longitudinal direction, and thereby permit alignment of cutting edges 38, 39 with respect to guard bar 64.

In accordance with the present invention, four integrally formed supporting posts or lands 3, 4, 5, 6 extend upwardly from blade seat member through perforations 3', 4', 5', 6' at outer end of slots 32, 33 of bottom blade 14 and into abutting engagement with underside of top blade 18 to bias it against the underside of cap member 20. Integrally formed supporting posts or lands 7, 9, 9 extend downwardly from cap member 20 through top blade 18 at 7', 8', 9' into abutting engagement with top surface of bottom blade 14 to bias it into abutting engagement with blade seat member 12. Cap member 20 has ledge members 90, 91 which pass through cutout portions 84 in the outer ends of top blade 18 into abutting engagement with the outer ends of bottom blade 14 to bias its outer members into abutting engagement with blade seat member 12. Ledges 90, 91 and lands 3 through 9 each have frangible raised surfaces 92, 93, 94 which are deformed as the components of the cartridge 10 are compressed prior to staking the posts 22 through 25.

Figure 10:
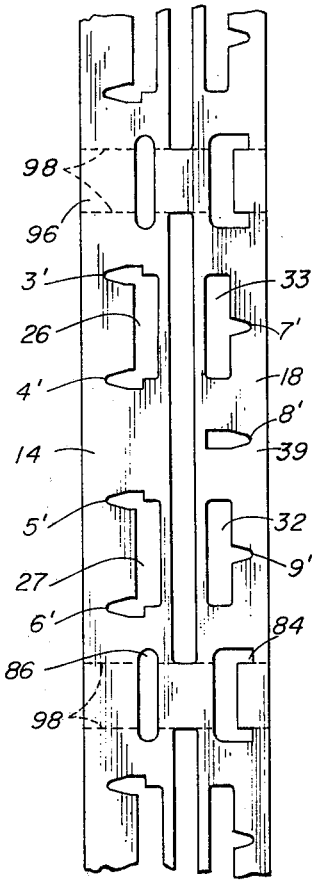
FIG. 10 is a top plan view of perforated blade material suitable to form the blades of the cartridge.

The lands 3 through 9 abutting against blades 14, 18 maintain space between such blades for passage of shaving debris and rinse water. The space is in communication with a plurality of ports 44–49 formed at the rear of the cartridge through which shaving debris passes from between the blades when subjected to a rinsing action. FIG. 10 shows a perforated strip of blade material having cutting edges formed on the outer sides. The strip cut along lines 98 to provide the top and bottom blades 14, 18; the portions 96 are discarded or recycled.

The embodiment described herein is intended to be illustrative and not delimiting of applicant's invention. Those modifications and variations as are obvious to one of ordinary skill in the art are considered to be within the scope of applicant's invention.

What is claimed is:

1. A safety razor comprising:

a. a plastic blade seat member including a transversely elongated guard surface, a platform and a first plurality of integral support posts having lands thereon and extending from said platform;

b. a first razor blade on said blade seat platform member, said first blade including a cutting edge spaced upwardly and rearwardly of said guard surface, and a plurality of perforations formed therethrough, said first plurality of support posts extending through the perforations in said first blade;

c. a second razor blade in abutting engagement with said lands of said first plurality of support posts, said second blade including a cutting edge spaced upwardly and rearwardly of the cutting edge of said first blade, and a plurality of perforations formed therethrough;

d. a plastic cap member on said second blade, said cap member including a surface for supporting said second blade, a second plurality of integral support posts having lands thereon extending from said support surface through the perforations in said second blade, said cap post lands in abutting engagment with the top surface of said first blade; and e. means interconnecting said cap and blade seat members for permanently bonding said first and second blades between said cap post lands and blade seat platform and said blade seat post lands and said cap support surface respectively.

2. The cartridge of claim 1 wherein the surfaces of said first and second pluralities of lands adjacent to said cutting edges are beveled.

3. The cartridge of claim 1 wherein a plurality of ports are formed in the rear of said cartridge and in communication with the space between said first and second blades.

4. The cartridge of claim 1 wherein said blade seat member includes a plurality of holes, and wherein said bonding means comprises a plurality of posts extending downwardly from said cap member through the holes in said seat member, said posts being deformed at the lower ends thereof to prevent removal.

5. The cartridge of claim 1 wherein said first and second pluralities of lands are transversely and alternately spaced along the cartridge.

6. The cartridge of claim 1 wherein said first and second pluralities of lands each include frangible surfaces for abutting engagement with the respective one of said first and second blades.

* * * * *